US005732494A

United States Patent [19]

Davey

[11] Patent Number: 5,732,494

[45] Date of Patent: Mar. 31, 1998

[54] BANNER MATERIAL HOLDER

[76] Inventor: Glenn Davey, 914 Homestead Dr., Newton, N.J. 07860

[21] Appl. No.: 689,609

[22] Filed: Aug. 12, 1996

[51] Int. Cl.[6] ..... G09F 17/00

[52] U.S. Cl. ..... 40/604; 160/391; 160/327; 248/309.1; 248/475.1; 248/495; 38/102.21

[58] Field of Search ..... 40/604, 603, 617; 160/383, 391, 395, 399, 402, 327, 368.1; 248/309.1, 205.1, 231.41, 475.1, 466, 495; 38/102.21, 102.91

[56] References Cited

U.S. PATENT DOCUMENTS

| | | | |
|---|---|---|---|
| 292,333 | 1/1884 | Lobdell . | |
| 316,771 | 4/1885 | Gerdom . | |
| 444,230 | 1/1891 | Strauss . | |
| 667,982 | 2/1901 | Kerr | 160/399 |
| 1,302,421 | 4/1919 | Okihara | 38/102.21 |
| 1,335,854 | 4/1920 | O'Callahan . | |
| 1,406,685 | 2/1922 | Rohr | 160/402 |
| 1,715,707 | 6/1929 | Jenkins . | |
| 2,350,235 | 5/1944 | Johnson . | |
| 3,217,690 | 11/1965 | Mihalisin . | |
| 3,310,899 | 3/1967 | Hart et al. . | |
| 3,537,201 | 11/1970 | Huey et al. . | |
| 3,824,725 | 7/1974 | Friedrichsen | 40/604 |
| 4,103,445 | 8/1978 | Smith et al. . | |
| 5,068,988 | 12/1991 | Mason . | |
| 5,347,732 | 9/1994 | Padawer | 160/395 X |
| 5,373,653 | 12/1994 | Suzuki . | |
| 5,398,436 | 3/1995 | Suzuki . | |
| 5,408,770 | 4/1995 | Suzuki . | |
| 5,499,789 | 3/1996 | Rose | 40/617 X |
| 5,522,165 | 6/1996 | Molla | 40/604 |
| 5,555,659 | 9/1996 | Hade | 40/604 |

*Primary Examiner*—Robert Canfield
*Attorney, Agent, or Firm*—Thomas L. Adams

[57] ABSTRACT

A banner material holder has a bar supported against loads by a support device. The bar has at a predetermined circumferential position a longitudinally disposed opening for holding one of the edges of the banner material. The bar is adapted to attach to the support device along a transverse axis that is angularly spaced from the predetermined circumferential position. After an edge of the banner material is secured along the bar at the predetermined circumferential position, a portion of the banner material is wound around the bar. Then the bar is supported along the transverse axis.

28 Claims, 4 Drawing Sheets

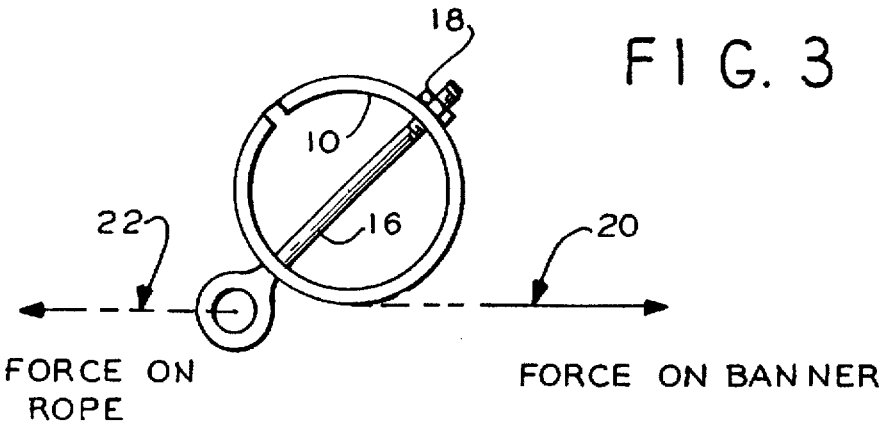
FIG. 3
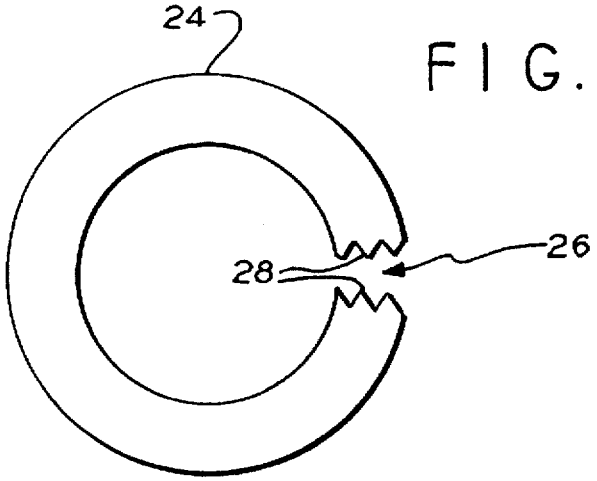
FIG. 4
FIG. 9
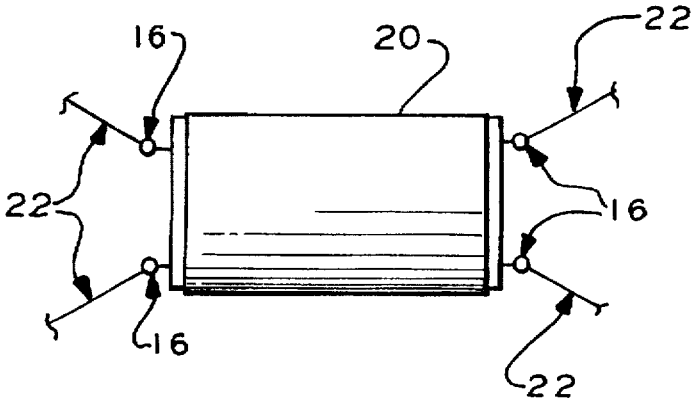

BANNER MATERIAL HOLDER

BACKGROUND OF THE INVENTION

1. Field of the Invention

The present invention relates to banner material holders, and in particular, to bars having means for holding banner materials.

2. Description of Related Art

Banners are typically hung between poles or on the sides of buildings by means of ropes or other lines secured to the corners of the banner material to hold it in place against environmental forces such as wind gusts. Wind gusts often create enough force on the banner material to tear the banner material and separate the ropes from their attachment point.

One common method of supporting the banner is to attach a strip of webbing encompassing a D-ring to each of the four corners of the banner material. Then ropes are tied to the D-rings and secured to a fixed object.

Another method of support is to install grommets at the four corners of the banner material, and then secure ropes to the grommets. In either case, attachment is concentrated at a point, which may not provide adequate strength to prevent environmental forces from tearing one or all of the ropes from the banner.

U.S. Pat. No. 444,230 shows a curtain pole formed of two hinged, semi-cylindrical segments. The top edge of a curtain may be placed between the semi-cylindrical halves and held by squeezing the two halves together with a thumb nut. The support for the pole is at the hinge, that is, a position opposite the opening that holds the curtain. Therefore, tension on the curtain does not tend to tighten the grip of the holder.

U.S. Pat. No. 3,217,690 shows a split tube that can be snapped together by pressing a bead on one face of the split into a groove on the opposing face of the split. This structure lacks fastening capabilities to support the banner on a fixed structure.

U.S. Pat. No. 316,771 shows a tube with a slit designed to hold the hem of a shade. End caps are used to hold the slit closed. This structure has no provision for gripping the hem of the shade tighter with increased tension.

U.S. Pat. No. 292,333 displays the method of supporting a curtain in a vertical position using a curtain stick having a number of pointed fasteners. A curtain can be fastened on the pointed ends of the fasteners, which are then bent over. This structure does not provide the support required to hold a banner in the vertical position.

U.S. Pat. No. 3,537,201 shows the edge of banner material wrapped around a rope and then inserted through a slit in a tube. The slit can be held together by a rivet. This structure provides a rigid structure that does not provide for increased gripping with increased tension.

See also U.S. Pat. Nos. 1,335,854; 1,715,707; 2,350,235; 3,310,899; 4,103,445; 5,068,988; 5,367,653; 5,398,436; and 5,408,770.

Accordingly, there is a need for an improved banner material holder that distributes the tension forces to avoid tearing the banner material and avoids tearing or detachment of the banner material under high wind loads.

SUMMARY OF THE INVENTION

In accordance with the illustrative embodiments demonstrating features and advantages of the present invention, there is provided a holder for banner material that has a spaced pair of edges. The holder includes a bar having at a predetermined circumferential position, a longitudinally disposed holding means for holding one of the edges. The holder also has a support means for supporting the bar against loads thereon. The bar is adapted to attach to the support means along a transverse axis that is angularly spaced from the predetermined circumferential position.

A method according to another aspect of the present invention employs a bar for holding an edge of a banner material. The method includes the step of securing the edge of the banner material along the bar at a predetermined circumferential position. Another step is winding a portion of the banner material around the bar. The method further includes the step of supporting the bar along an attachment axis that is transverse to the bar and is angularly spaced from the predetermined circumferential position.

By employing such equipment, an improved holder and method of support is achieved. In the preferred embodiment, the holder is a cylindrical tube with a slit cut in the longitudinal direction and holes drilled near the ends. The holes are preferably spaced 90° from the slit. A banner material to be mounted is inserted into the slit and wrapped, typically, one and one-half times around the circumference of the tube.

In some embodiments a fastener is then punched through the banner material to pass through the existing holes in the tube. The fastener may then be secured in place and tightened to squeeze the slit together and secure the banner material. The fastener preferably becomes the attachment point that is used to secure the banner to a supporting structure. In other embodiments, the fasteners are eliminated and a rope is threaded directly through the holes in the bar.

With such apparatus, the forces normally exerted on the corners of the banner material from wind gusts, and other environmental conditions, are spread across the complete width of the banner material. Also, winding the banner material increases frictional holding forces using a capstan effect. Also, the fasteners are positioned to compress the bar and squeeze the banner material in the slit to further increase holding tension. Therefore, the banner material is more likely to resist tearing or being pulled from its securing points. In addition the fastener provides convenient mounting points for the securing ropes.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 3 is a free body diagram showing the forces associated with the banner material;

FIG. 4 is an end view of a bar having a toothed slit, and which is an alternate to the bar of FIG. 1;

FIG. 9 is an elevational view of a banner material suspended using the banner material holder of FIG. 1.

DETAILED DESCRIPTION OF THE PREFERRED EMBODIMENTS

Figure 1:
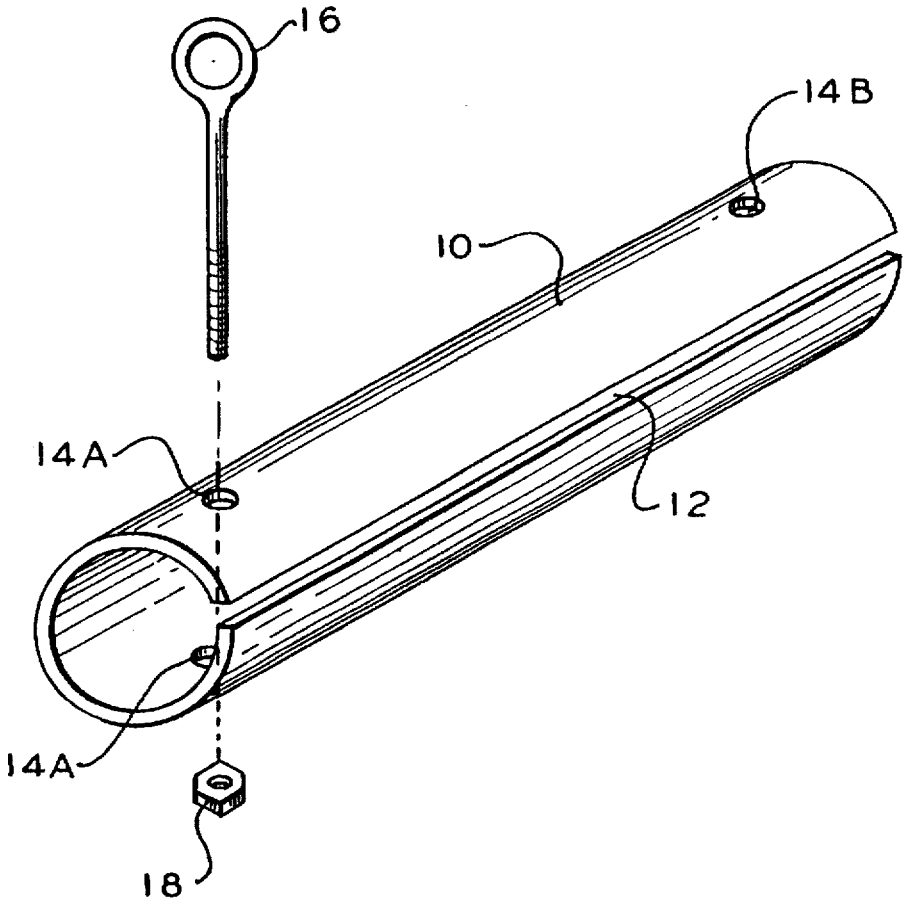
FIG. 1 is an exploded, axonometric view of an holder in accordance with the principles of the present invention.

Referring to the holder of FIG. 1, a bar is shown as a hollow cylindrical tube 10 having a slit 12 through its wall. Slit 12 runs parallel to the longitudinal axis of tube 10. Tube 10 has an inner diameter of ¾ inch (1.9 cm) and an outer diameter of 1.0 inches (2.5 cm), although other dimensions are contemplated as well. The tube 10 may be made of plastic or a lightweight metal such as aluminum.

Slit 12 is runs the entire longitudinal length of tube 10 and with a gap size sufficient to accommodate the thickness of a banner material. The term "banner material" as used herein refers to a flexible sheet used as a sign, decoration or otherwise, and which is made of cloth, plastic or other materials.

Two anchor holes 14A and 14B (herein referred to as an example of an attachment means) are drilled through the tube 10. These holes are spaced inwardly from the ends of tube 10 a distance that is about 10 to 30% of the overall length of tube 10. Holes 14A and 14B are sufficiently large to accept the fastener to be described presently. Anchor holes 14A and 14B must be close enough to the ends of tube 10 to prevent the unsupported (normally horizontal) edge of the banner material from curling and to prevent the ends of the tube from bending. Also the anchor holes 14A and 14B must be far enough away from the ends of tube 10 to prevent sagging at the middle of tube 10. At the same time the anchor holes must be located to provide a good balance point for the attaching ropes.

A support means designed to penetrate the diameter of tube 10 and be secured to the other side is also shown in FIG. 1 as fastener 16. The length of fastener 16 extends though holes 14A and 14B along what is herein referred to as a transverse axis. Fastener 16 is shown as an aluminum or steel eyebolt and may have a pointed end for penetrating through the banner material. The fastener has a threaded shank to accommodate a nut 18 to secure fastener 16 to tube 10. Tightening of nut 18 applies pressure to close slit 12 and prevent the banner material from being pulled out of tube 10. The other end of fastener 16 has an eye used for tieing the banner material holder to a structure.

Figure 2:
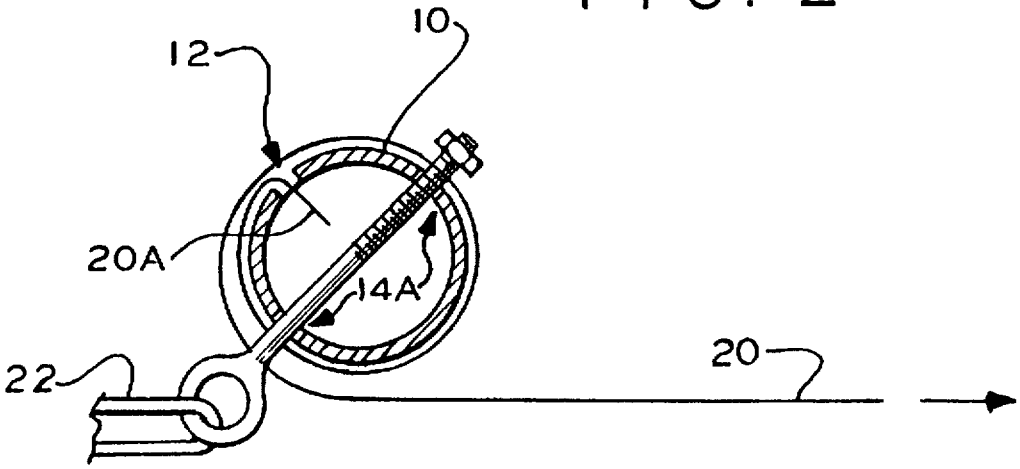
FIG. 2 is an end view of the holder of FIG. 1 shown supporting a banner material.

To facilitate an understanding of the principles associated with the foregoing apparatus, its operation will be briefly described. A supported (typically vertical) edge 20A of banner material 20 is inserted into slit 12 of tube 10, as shown in FIG. 2. In this manner slit 12 acts as a holding means. Banner material 20 is then wrapped around the circumference of tube 10 preferably one to three turns, and in this embodiment, about one and one-half turns, thereby completely covering tube 10. The winding of banner material 20 around tube 10 creates a frictional force between banner material 20 and tube 10 that provides additional resistance to wind gusts and prevents banner material 20A from being pulled out of the banner material holder. Also the slit 12 will be squeezed closed on the banner material 20A due to the compression caused by tension on the banner material 20 wound around tube 10.

In order to attach fasteners 16 to tube 10, it is necessary to locate the holes in the tube 10 and pierce through the windings of banner material 20 and into tube 10. Once inserted through banner material 20 and tube 10, fastener 16 is secured with nut 18 to prevent fastener 16 from being removed from tube 10. Tightening nut 18 clamps the edge of banner material 20A within tube 10 and increases its resistance to wind and other environmental forces. The slit 12 is located at predetermined circumferential position that is angularly spaced 90° from the holes 14A and 14B. It will be appreciated that in other embodiments a different angular spacing may exist between slit 12 and holes 14A and 14B.

A second banner material holder is attached to the opposite edge of banner material 20 in a similar fashion, as shown in FIG. 9. The banner material holder with the attached banner material can now be secured to a fixed structure by tieing lines 22 to fasteners 16.

Once suspended, fastener 16 swings to align the forces exerted on tube 10. The supporting force on fastener 16 must be opposed to the forces on banner material 20 as shown in the free body diagram of FIG. 3. Any wind force exerted on banner material 20 will be applied tangentially to tube 10. Accordingly, banner material 20 will wind/unwind to swing the eye of fastener 16 and align the forces as illustrated. The forces will tend to tighten the winds of the banner material and increase the frictional force between it and the tube 10. Also the slit in the tube 12 will compress to squeeze the end of banner material 20A.

Referring to the alternate embodiment of FIG. 4, a longitudinal slit 26 exists in cylindrical tube 24. The opposing edges of slit 26 may be fluted or grooved to provide the teeth 28 as shown in FIG. 4. The opposing teeth 28 are arranged to mesh with each other and provide a firm grip on the banner material.

Figure 5:
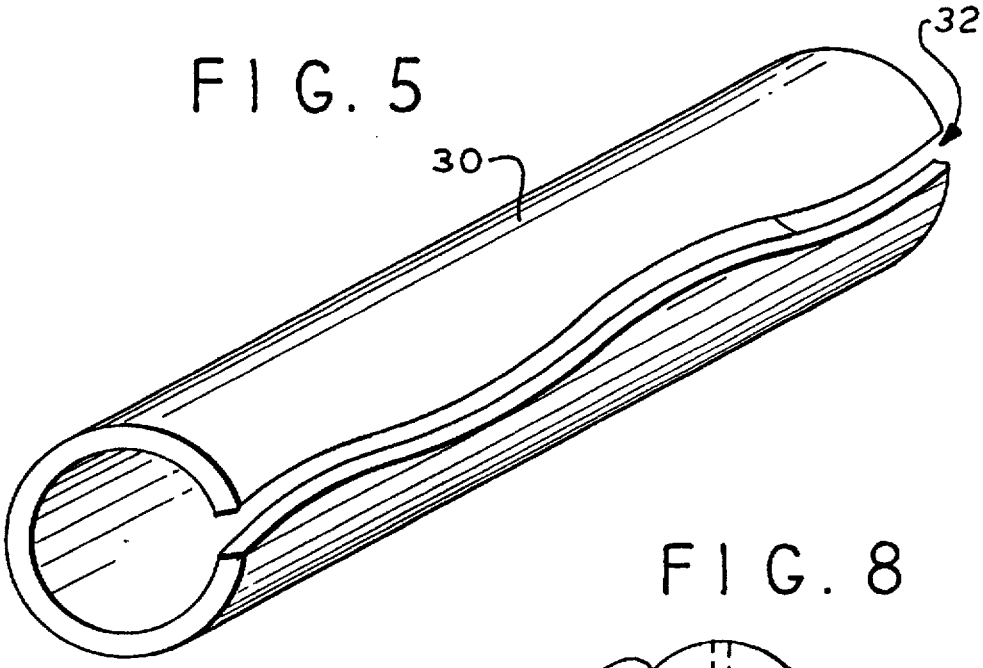
FIG. 5 is an axonometric view of a bar having an undulating slit and which is an alternate to the bar of FIG. 1.

Referring to the other embodiment of FIG. 5, cylindrical tube 30 has a longitudinal slot 32, which undulates. This would effectively provide blunt, intermeshing teeth and would more positively secure the banner material.

Figure 6:
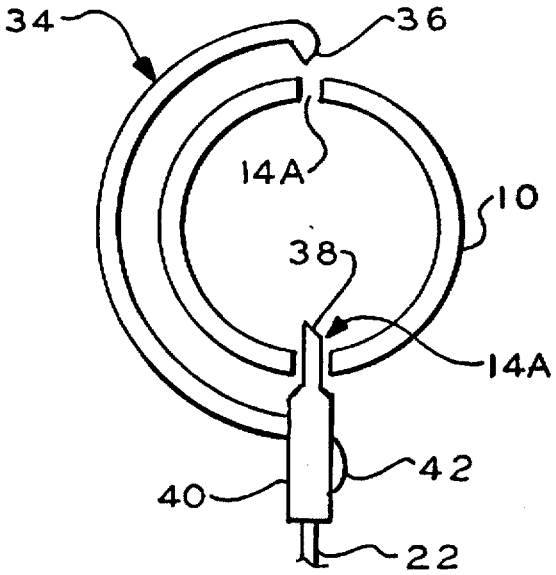
FIG. 6 is an end view of a holder employing a C-shaped clamp, and which is an alternate to the holder of FIG. 1.

Referring to FIG. 6, an alternate fastener 34 is shown as a C-shaped clip for holding previously illustrated tube 10. The distal tip 36 of fastener 34 can be inserted into hole 14A of cylindrical tube 10. An opposing tip 38 can be retractably mounted in the base 40 of fastener 34. The tip 38 can be manually retracted using knob 42 or extended to land into hole 14A. The base is attached to previously mentioned support line 22.

This type of fastener would penetrate the banner material and enter the holes 14A in the tube 10 without passing completely through the tube. Tip 38 is part of a sliding bolt arrangement that can be retracted into its base 40 to enable the fastener to be positioned around the slitted tube. The sliding bolt can be released and spring loaded to provide the force necessary to keep the fastener secured into the anchoring holes 14A.

Figure 7A:
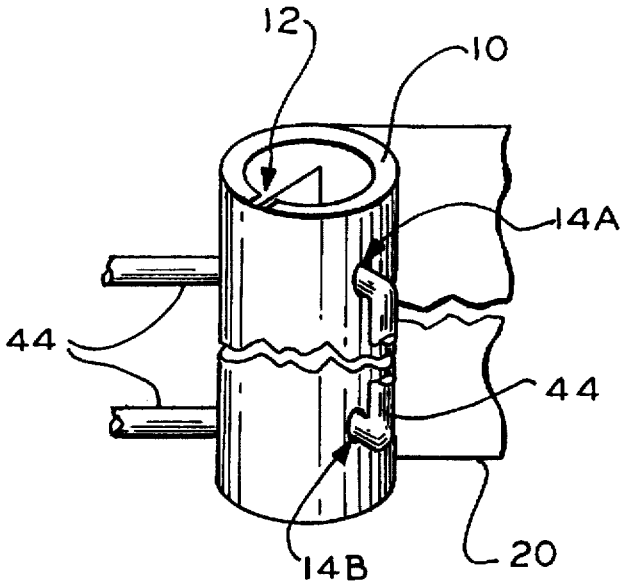
FIG. 7A is a side view of a holder supported by lines without fasteners, and which is an alternate to the holder of FIG. 1.

Referring to FIG. 7A, the fasteners just described can be replaced by a line 44 that is threaded through anchor holes 14A and 14B. This line 44 would be inserted through puncture holes in banner material 20 made by an awl or other tool. The line 44 can be threaded through the assembly using a guide straw, a pick or other implement. Once threaded through hole 14A, for example, line 44 would run along the proximal side of tube 10 before being threaded through the other anchor hole (e.g., hole 14B). The ends of line 44 would then be secured to appropriate fixed supports.

This would allow line 44 to be used to support banner material 20. As additional load is placed on banner material 20 by the wind the wrapping of banner material 20 will tighten to increase frictional force and to squeeze the slit 12 to increase its holding capacity.

Figure 7B:
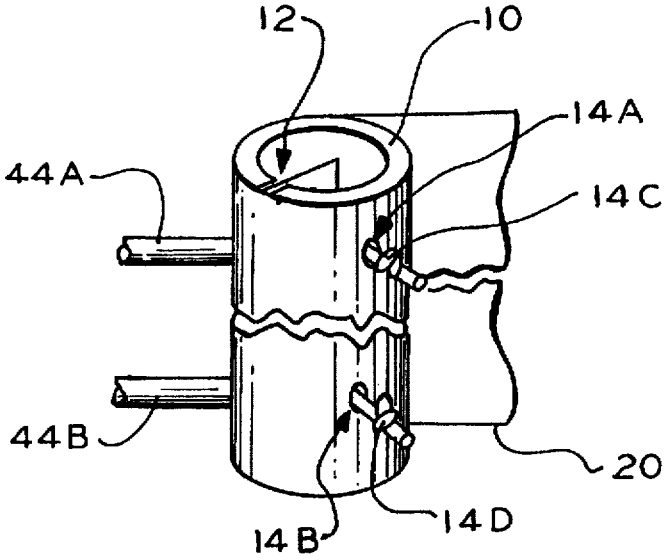
FIG. 7B is a side view of a holder supported by lines without fasteners, and which is an alternate to the holder of FIG. 7A.

The line 44 need not be a continuous loop as illustrated. Instead the line may be made of the two sections 44A and 44B shown in FIG. 7B. In this embodiment the lines 44A and 44B are threaded through holes 14A and 14B and puncture holes in banner material 20 before being terminated in knots 44C and 44D. Instead of knots, in alternate embodiments the lines 44A and 44B may be terminated in fasteners or lugs of various types.

Figure 8:
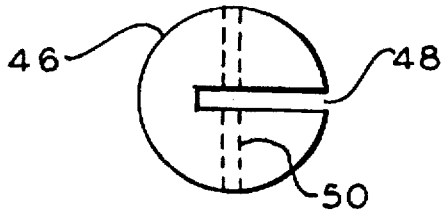
FIG. 8 is an end view of a bar that is an alternate to that of FIG. 1.

Referring to FIG. 8, an alternate bar 46 is shown. In this embodiment bar 46 is solid not hollow. As opposed to a slitted tube, solid bar 46 has a slot 48 that runs diametrically ¾ of the way through bar 46. An edge of the banner material may be inserted into slot 48 in a manner similar to that just described for the slits in the previously mentioned tubes. A diametric hole 50 is placed at right angles to the slot 48. Holes 50 are positioned to hold fasteners of the type previously described in connection with the earlier embodiments. A fastener may be placed in hole 50 after banner material is wrapped around the bar 46 and tightened to squeeze close the slot 48. Otherwise, the bar 46 operates in a manner similar to that previously described.

The bar can take various shapes and may have a cross-sectional outline that is polygonal, oval or shaped otherwise. The bars may be made of plastic, metal, wood, or other appropriate materials. Instead of slits, various other types of holding means may be used including various clamps or adhesives to initially hold in place the edge of the banner material. The length and thickness of the bars may be altered depending upon the expected size of the banner, the desired strength, weight, etc. While a pair of fasteners is shown mounted transversely through the bars. In some embodiments three or more fasteners may be used instead. The support lines may be rope, steel cable, or various other types of cords. While the fasteners are shown attaching to holes in the bar, in some embodiments the bar may have outwardly projecting studs onto which the fasteners may be secured.

It is appreciated that various modifications may be implemented with respect to the above described, preferred embodiment. For example, variation is the use of a tube without a slot or a non cylindrical tube. In addition, it may be solid tube that has a cylindrical, hexagonal or any other polygonal shape. In each variation, the wrapping of banner material 20 around the circumference of the element would provide the required frictional force to keep banner material 20 secure. If required, three or more anchor holes with three or more fasteners may be required to provide support for larger banners.

Obviously, many modifications and variations of the present invention are possible in light of the above teachings. It is therefore to be understood that within the scope of the appended claims, the invention may be practiced otherwise than as specifically described.

I claim:

1. A holder for a banner material having a spaced pair of edges, comprising:

a bar having at a predetermined circumferential position a longitudinally disposed holding means with a longitudinal opening for holding and allowing winding over one of said edges; and a support means for supporting said bar and increasing holding at said longitudinal opening in response to increasing loads through said, support means, said bar being adapted to attach to said support means along a transverse axis, said predetermined circumferential position on said bar being angularly spaced from said transverse axis.

2. A holder according to claim 1 wherein said bar has at said transverse axis:

an attachment means for attaching to said support means.

3. A holder according to claim 2 wherein said attachment means comprises:

a hole transpiercing said bar.

4. A holder according to claim 1 wherein said support means is operable to compress said longitudinal opening in response to loads on said bar.

5. A holder according to claim 4 wherein said longitudinal opening is sized to receive one of said edges of said banner material, said bar having at said transverse axis:

an attachment means for attaching to said support means.

6. A holder according to claim 5 wherein said bar is hollow.

7. A holder according to claim 5 wherein said bar has the shape of a split tube.

8. A holder according to claim 5 wherein said bar has the shape of a slotted solid.

9. A holder according to claim 5 wherein said opening of said bar is toothed.

10. A holder according to claim 5 wherein said opening of said bar comprises an undulating slit.

11. A holder according to claim 1 wherein said support means comprises:

a longitudinally spaced pair of fasteners.

12. A holder according to claim 11 wherein said longitudinal opening is sized to receive an edge of said banner material, each of said fasteners comprising:

a shank adapted to be mounted transversely through said bar.

13. A holder according to claim 12 wherein each of said shanks is mounted diametrically through said bar, said longitudinal opening being spaced about 90° from said shanks.

14. A holder according to claim 11 wherein each of said fasteners comprises:

an eyebolt.

15. A holder according to claim 5 wherein said support means comprises: a flexible line secured to said bar.

16. A holder according to claim 15 wherein said attachment means comprises:

a hole transpiercing said bar, said line being threaded through said hole and knotted.

17. A holder according to claim 15 wherein said attachment means comprises:

a spaced pair of holes transpiercing said bar, said line being threaded in a loop through both of said holes.

18. A holder according to claim 5 wherein said support means comprises:

a C-shaped clip having a pair of opposing tips adapted to embrace said bar and attach to said attachment means.

19. A method employing a bar with a longitudinal opening for holding an edge of a banner material, comprising the steps of:

securing the edge of the banner material in said longitudinal opening along said bar at a predetermined circumferential position;

winding a portion of said banner material around said bar and over the edge of said banner material; and supporting said bar along an attachment axis that is (a) transverse to said bar and (b) oriented to increase holding at said longitudinal opening in response to increased loading along said attachment axis, said predetermined circumferential position being angularly spaced from said attachment axis.

20. A method according to claim 19 wherein the step of winding said banner material is performed by:

winding said banner material between once to twice around said bar.

21. A method according to claim 19 wherein the step of securing the edge of said banner material is performed by:

inserting the edge of said banner material into said longitudinal opening.

22. A method according to claim 21 wherein the step of supporting said bar is performed by:

placing said bar in compression along said attachment axis to squeeze said longitudinal opening onto said edge of said banner material.

23. A method according to claim 21 wherein the step of supporting said bar is performed along the attachment axis, which is angularly spaced about 90° from said predetermined circumferential position.

24. A method according to claim 19 employing a shank and wherein the step of supporting said bar is performed by:

attaching said shank through said bar along said attachment axis; and tieing line to said shank to suspend said bar.

25. A method according to claim 24 wherein the step of attaching said shank is performed by:

puncturing the portion of said banner material wound around said bar to allow passage of said shank through said banner material and through said bar.

26. A method according to claim 19 employing a pair of shanks and wherein the step of supporting said bar is performed by:

attaching said shanks through said bar in spaced positions parallel to said attachment axis; and tieing line to said shanks to suspend said bar.

27. A method according to claim 19 wherein said bar has a hole transpiercing said bar, and wherein the step of supporting said bar is performed by:

threading line through said hole; and knotting said line.

28. A method according to claim 19 wherein said bar has a spaced pair of holes transpiercing said bar, and wherein the step of supporting said bar is performed by:

threading line in a loop through both of said holes.

* * * * *